US005458523A

United States Patent [19]

Aoki et al.

[11] Patent Number: 5,458,523

[45] Date of Patent: Oct. 17, 1995

[54] ACTION CHARACTER FIGURE ASSEMBLY

[75] Inventors: Hironobu Aoki, Tokyo; Minoru Sugiyama, Chiba, both of Japan

[73] Assignee: Hasbro, Inc., Pawtucket, R.I.

[21] Appl. No.: 369,218

[22] Filed: Jan. 5, 1995

[30] Foreign Application Priority Data

May 25, 1994 [JP] Japan ..... 6-133943

[51] Int. Cl.[6] ..... A63H 13/06; A63F 9/14

[52] U.S. Cl. ..... 446/246; 446/309; 446/333; 273/85 B

[58] Field of Search ..... 446/287, 280, 446/288, 246, 236, 238, 237, 333–336, 308–311; 273/85 B, 85 D, 85 F

[56] References Cited

U.S. PATENT DOCUMENTS

| | | | |
|---|---|---|---|
| 1,452,820 | 4/1923 | Whitcomb et al. | 446/334 |
| 1,539,251 | 5/1925 | Findlay | 446/333 |
| 3,235,259 | 2/1966 | Glass et al. | 273/85 F |
| 3,864,870 | 2/1975 | Breslow et al. | 446/334 |
| 3,955,311 | 5/1976 | Lyons et al. | 446/335 |
| 4,031,657 | 6/1977 | Crosman et al. | 446/333 |
| 4,040,206 | 8/1977 | Kimura | 446/352 |
| 4,623,318 | 11/1986 | Tsiknopoulos et al. | 446/330 |
| 4,844,461 | 7/1989 | Namanny et al. | 273/85 F X |
| 5,009,424 | 4/1991 | Harth et al. | 273/85 D |

*Primary Examiner*—Mickey Yu
*Attorney, Agent, or Firm*—Kurt R. Benson

[57] ABSTRACT

An action character figure assembly includes a character figure, an elongated base and a control and mounting mechanism for releasably mounting the character figure on one leg thereof adjacent an end of the base. The control and mounting mechanism is remotely operable from the opposite end of the base for rapidly rotating the character figure about the axis of the first leg thereof so as to cause the character figure to perform various martial arts fighting maneuvers. The character figure includes a torso portion which is pivotally mounted on the first leg and a second leg and arms which are freely pivotably mounted on the torso portion so that they are centrifugally pivoted outwardly during a fighting maneuver.

13 Claims, 10 Drawing Sheets

ACTION CHARACTER FIGURE ASSEMBLY

BACKGROUND AND SUMMARY OF THE INVENTION

The instant invention relates to action character figures and more particularly to an action character figure assembly which is remotely operable for performing a variety of martial arts fighting maneuvers.

The general concept of providing an action character figure assembly comprising a remotely actuatable character figure which is operable for performing various fighting maneuvers has heretofore been relatively well-known. Further, the concept to providing a pair of action character figures in one or a pair of assemblies which are remotely actuatable for causing the character figures to perform various fighting maneuvers in a simulated fighting match has also heretofore been relatively well known. The U.S. Patents to Whitcomb et al., U.S. Pat. No. 1,452,820; Glass et al., U.S. Pat. No. 3,235,259; Breslow et al., U.S. Pat. No. 3,864,870; Crosman et al., U.S. Pat. No. 4,031,657; Namanny et al., U.S. Pat. No. 4,844,461; and Harth et al., U.S. Pat. No. 5,009,424, generally disclose apparatus which are exemplary of the previously known character figure assemblies of this type comprising pairs of character figures. Of these references, only the U.S. Patent to Crosman et al. relates to an apparatus which is remotely actuatable for causing character figures to perform martial arts fighting maneuvers. However, since the Crosman et al. reference is not directed to an apparatus which is capable of performing combat maneuvers with a high degree of speed and realism, even this reference is believed to be of only general interest with respect to the action character figure assembly of the instant invention.

The instant invention provides a unique and exciting action character figure assembly which is adapted for performing high speed martial arts maneuvers in a simulated fighting match. More specifically, the action character figure assembly of the instant invention comprises a character figure which is remotely operable for causing the entire body thereof to spin about a vertical axis so that the arms and one leg of the character figure swing outwardly in a simulated karate maneuver for contacting a second character figure in a high speed fighting match. Further, the character figure assembly comprises a chest plate which is vulnerable to a contacting blow from a second character figure for causing the first character figure to be ejected upwardly in a manner simulating a response to a knockout blow. Accordingly, a pair of the action character figure assemblies is effectively operable in a simulated high speed martial arts fighting match until one combatant in the match receives a knockout blow to the chest plate thereof, at which point that character figure is ejected in a manner simulating a reflex response to a knockout blow.

Still more specifically, and in accordance with the above, the action character figure assembly of the instant invention comprises a base, a character figure on the base, and a mounting and control mechanism which is operative for rotatably mounting the character figure on the base so that it is remotely operable for performing martial arts maneuvers thereon. The character figure, which includes a torso portion, first and second legs, and first and second arms, is mounted on the base through the first leg thereof so that the entire character figure is rotatable by rotating the first leg. The torso portion is pivotally mounted on the first leg so that the torso portion is pivotable thereon, but so that the torso portion normally assumes a substantially upright disposition when the first leg is not being rotated. The second leg is mounted on the torso portion so that it is freely pivotable in both forward and rearward directions thereon, and the arms are also mounted on the torso portion so that they are freely pivotable relative thereto. Accordingly, when the mounting and control mechanism is operated for rotating the character figure on the base, the torso portion is centrifugally pivoted in a forward direction on the first leg, and the second leg and the arms of the character figure are centrifugally pivoted outwardly to cause the character figure to perform simulated martial arts kicking and punching actions. The base upon which the character figure is mounted preferably includes an elongated shaft portion, and the action character figure is preferably rotatably mounted adjacent one end of the shaft portion. Further, the mounting and control mechanism is preferably operative from a point adjacent the opposite end of the shaft portion for remotely rotating the character figure on the base. The mounting and control mechanism preferably further includes a contact plate on the torso portion of the character figure which is depressible inwardly for actuating an ejecting mechanism portion of the mounting and control mechanism to eject the character figure from the base. The character figure is preferably ejected upwardly so that it is separated and disconnected from the base to simulate a response to a knockout blow delivered to the character figure. The torso portion of the character figure is preferably pivotally mounted on the first leg about an axis which extends angularly upwardly and toward the torso portion from the first leg at an angle of preferably approximately 45 degrees. Further, the character figure preferably includes an internal spring which operates in combination with the angular orientation of the first leg mounting axis so that when the first leg is not being rotated by the mounting and control mechanism, the torso portion normally assumes a substantially upright disposition. However, when the first leg is rotated on the base, the torso portion can nevertheless pivot forwardly to simulate a waist bending maneuver. The mounting and control mechanism preferably includes a remotely rotatable platform on the base and a mounting shaft which extends upwardly from the platform, and the character figure preferably has an upwardly extending opening in the first leg thereof, which is receivable on the mounting shaft for mounting the character figure on the base. Accordingly, by remotely rotating the platform and the mounting shaft, the character figure is rotatable in a manner which causes the second leg and the arms thereof to be pivoted outwardly so as to cause the character figure to perform various simulated martial arts maneuvers on the base.

Accordingly, it is a primary object of the instant invention to provide a character figure assembly comprising a remotely operable character figure which is capable of performing a variety of martial arts maneuvers.

Another object of the instant invention is to provide an effective remotely operable character figure assembly comprising a character figure which is capable of performing a variety of martial arts maneuvers in a simulated fighting match.

Another object of the instant invention is to provide an action character figure assembly comprising a character figure having freely pivotable arms and legs which is capable of performing a variety of body spin type martial arts maneuvers.

Other objects, features and advantages of the invention shall become apparent as the description thereof proceeds when considered in connection with the accompanying illustrative drawings with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
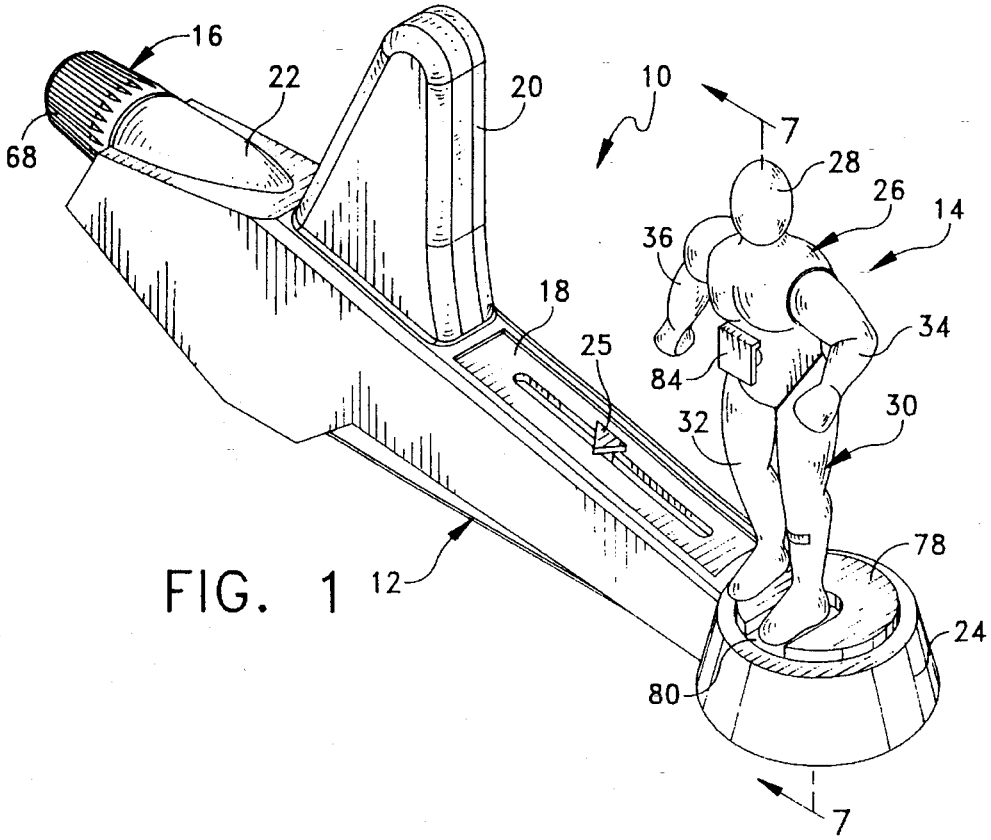
FIG. 1 is a perspective view of the action character figure assembly of the instant invention.
Figure 2:
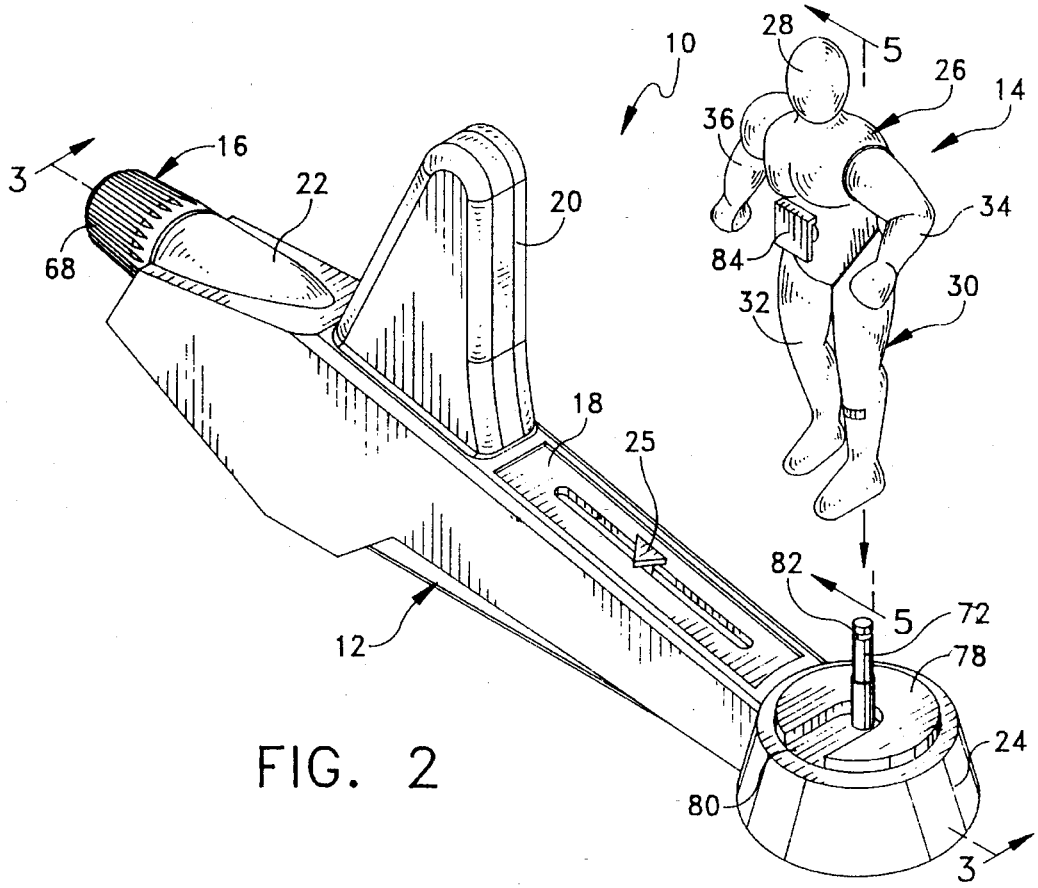
FIG. 2 is a similar perspective view thereof with the character figure ejected upwardly.
Figure 3:
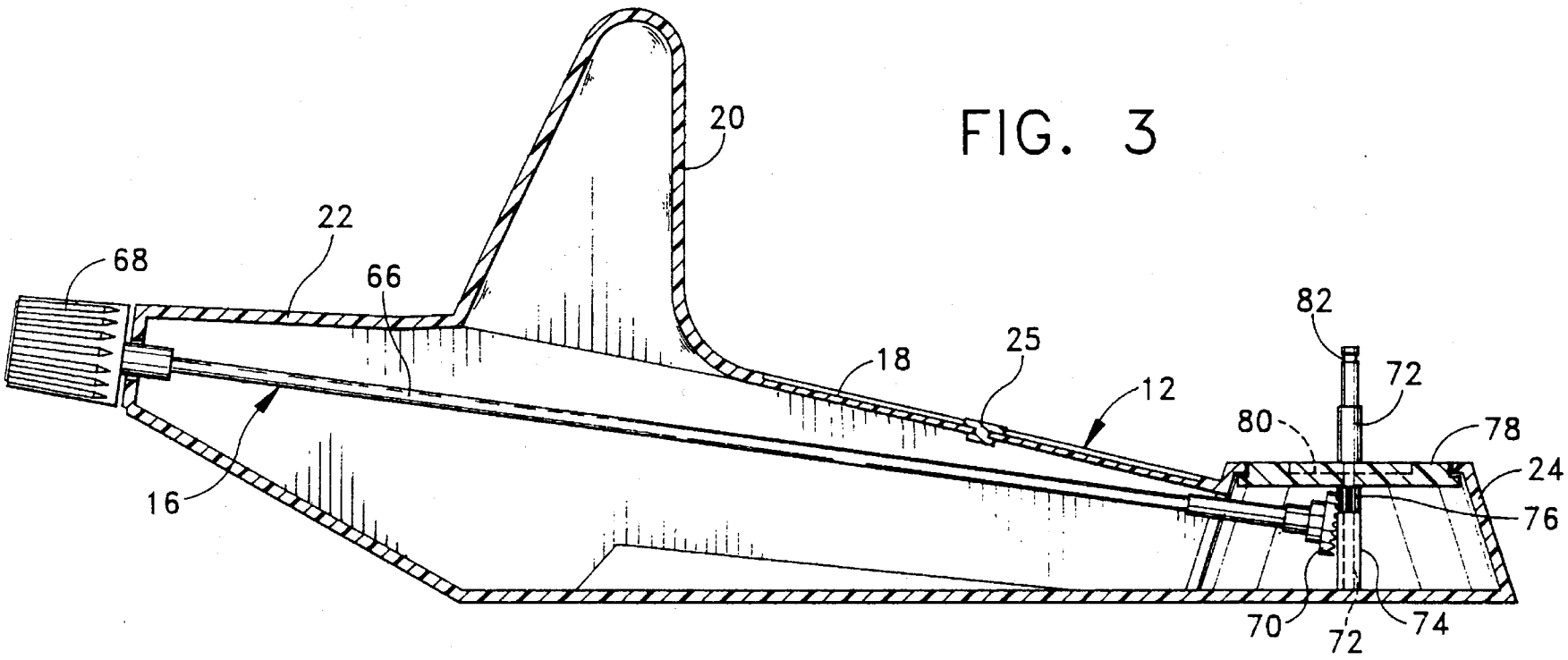
FIG. 3 is a sectional view taken along line 3—3 in FIG. 2.
Figure 4:
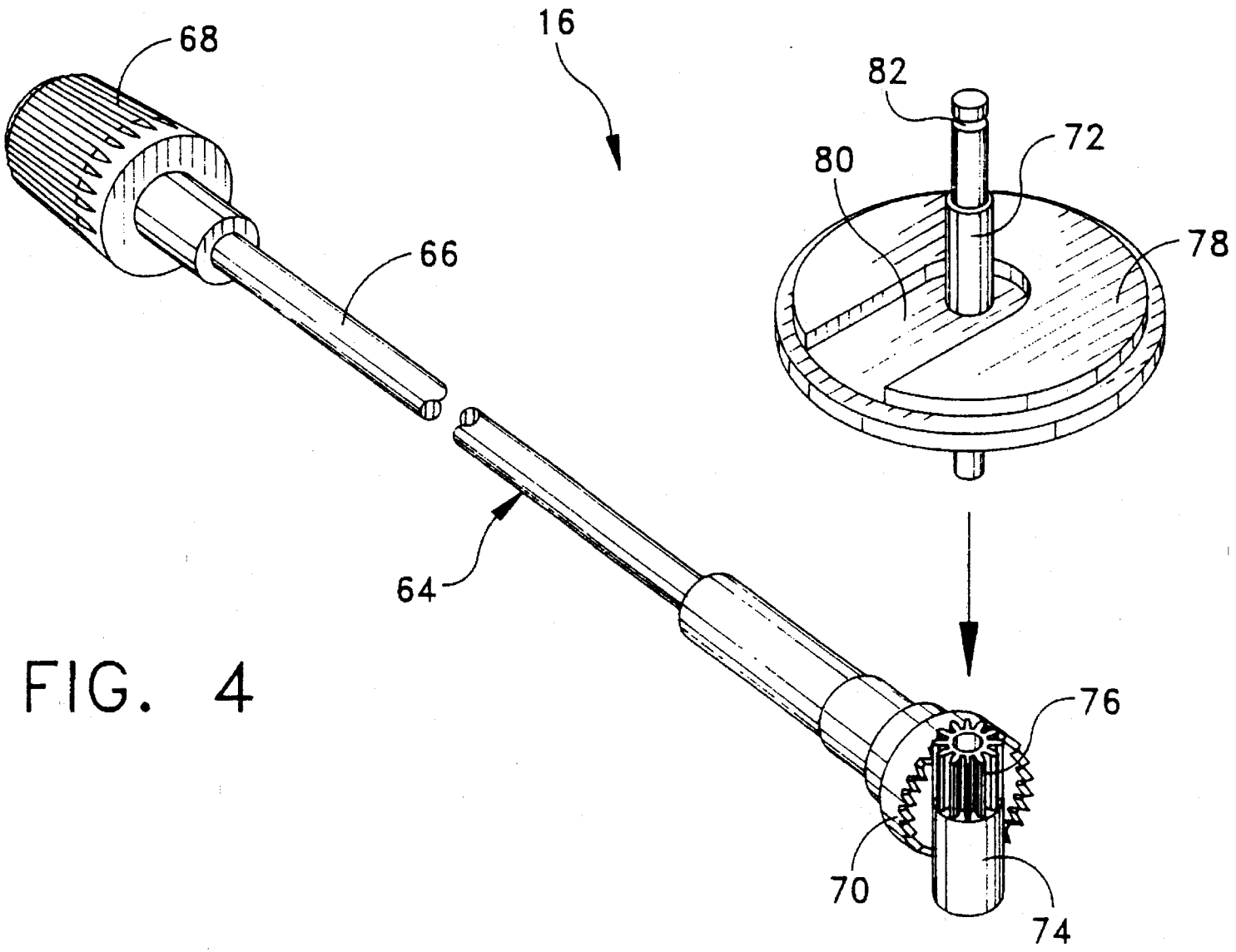
FIG. 4 is a partially exploded perspective view of the mounting and control mechanism.
Figure 5:
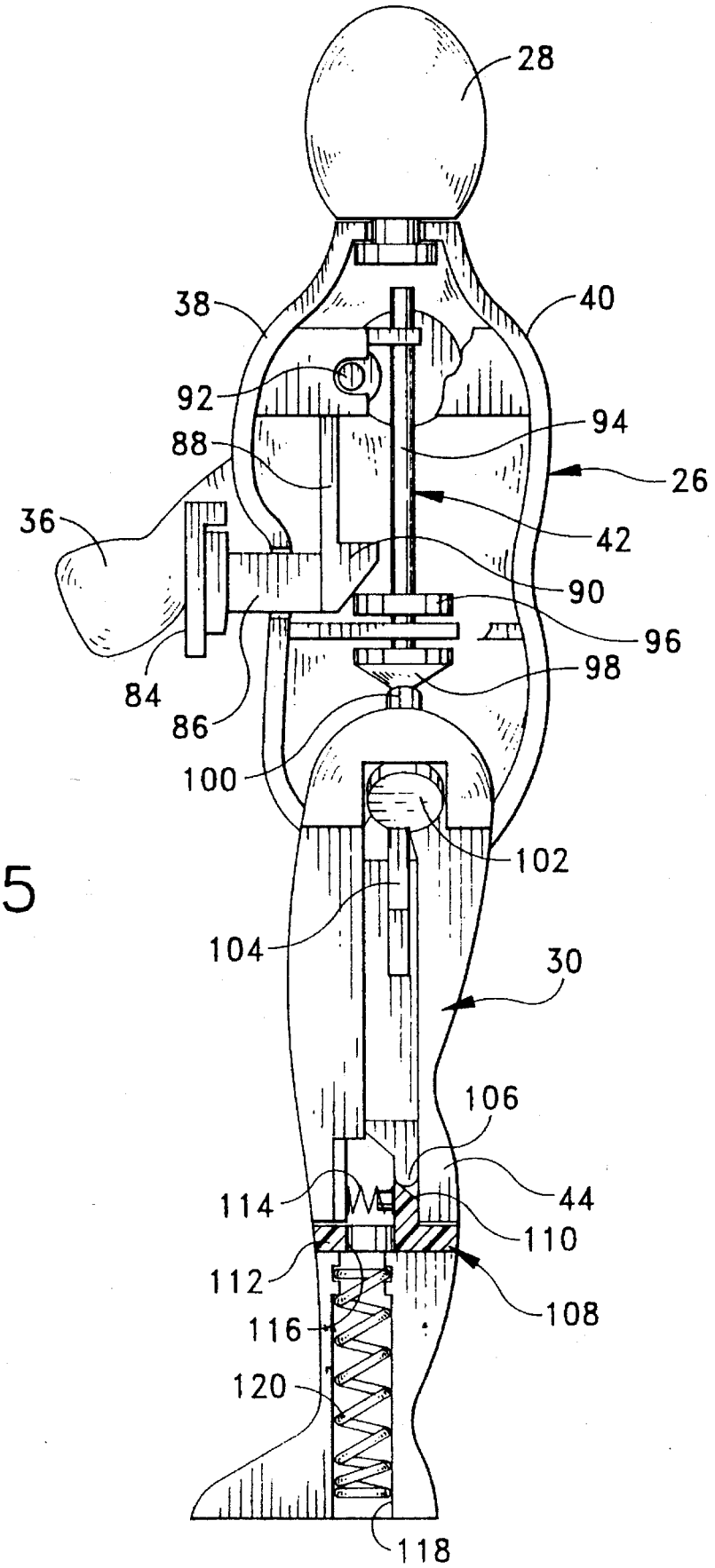
FIG. 5 is a sectional view taken along line 5—5 in FIG. 2.
Figure 6:
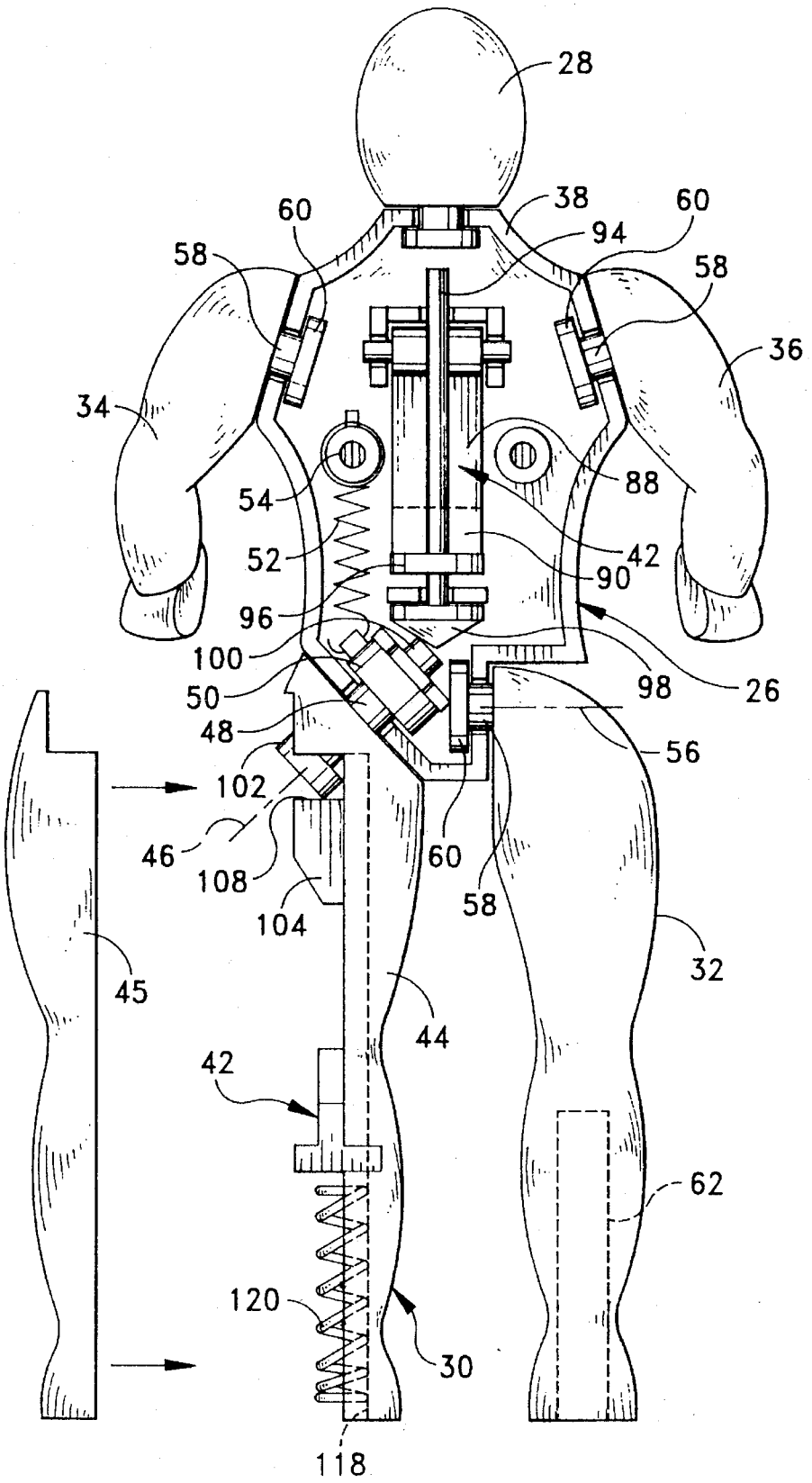
FIG. 6 is a rear elevational view of the character figure with portions of the left leg and the torso removed.
Figure 7:
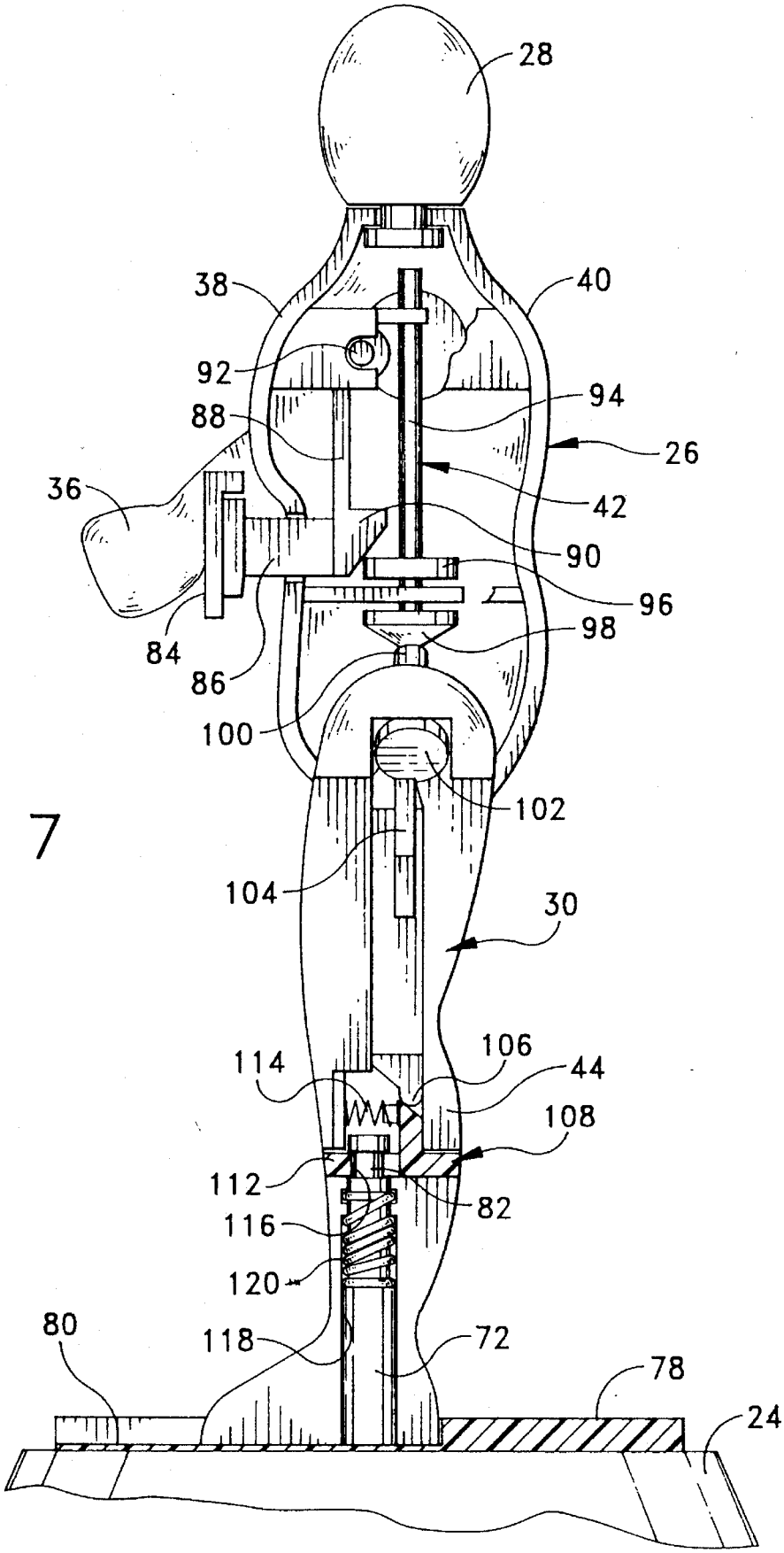
FIG. 7 is a sectional view taken along line 7—7 in FIG. 1.
Figure 8:
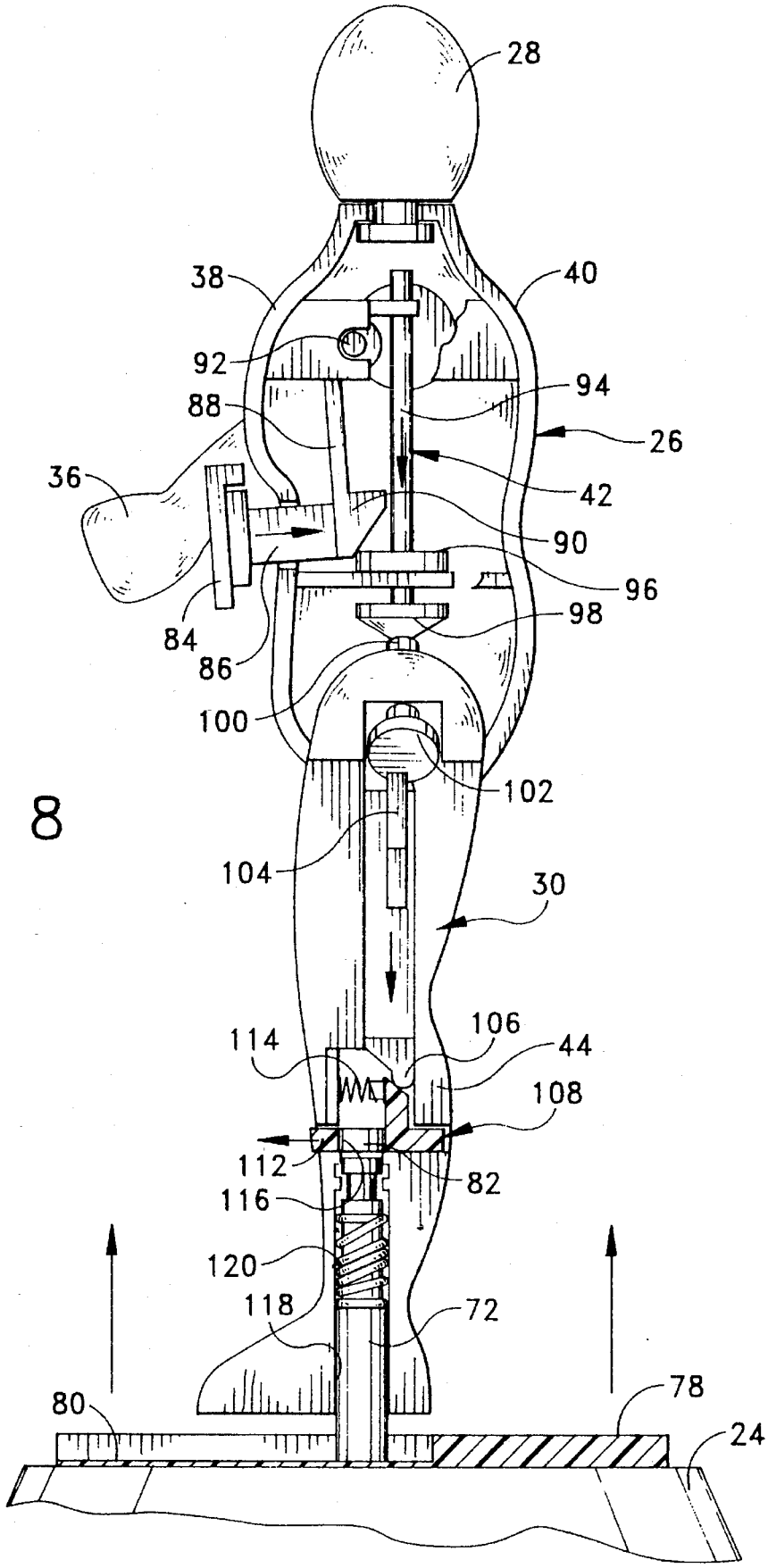
FIG. 8 is a similar view as the character figure is ejected upwardly.

Referring now to the drawings, the action character figure assembly of the instant invention is illustrated in FIGS. 1 through 11 and generally indicated at 10. The action character figure assembly 10 comprises a base generally indicated at 12, a character figure generally indicated at 14, and a mounting and control mechanism generally indicated at 16. The mounting and control mechanism 16 is mounted partially in the base 12 and partially in the character FIG. 14, and the action character FIG. 14 is adapted to be mounted on the base with the mounting and control mechanism 16. The action character FIG. 14 is constructed so that the arms and legs thereof are freely pivotable, and the mounting and control mechanism 16 is remotely operative for rotating the action character FIG. 14 on the base 12. Accordingly, by operating the mounting and control mechanism 16 to rotate the character FIG. 14, the legs and arms of the character FIG. 14 can be centrifugally pivoted outwardly to cause the character FIG. 14 to perform simulated martial arts maneuvers. Further, the mounting and control mechanism 16 is adapted so that the action character FIG. 14 is ejected upwardly from the base in the event that the character FIG. 14 sustains a damaging blow during the course of a simulated fighting match.

The base 12 comprises an elongated shaft portion 18, a control handle 20, a control end portion 22, and a mounting end portion 24. The base 12 is adapted to be received on a substantially flat supporting surface, and it provides a housing for containing a portion of the operative components of the mounting and control mechanism 16. The mounting end portion 24 is of substantially circular configuration, and it faces substantially upwardly at the forward end of the shaft portion 18 as illustrated. The control handle portion 20 is disposed adjacent the control end portion 22, and it is operative for pivoting or otherwise moving the shaft portion 18 to maneuver the mounting end portion 24 and the character FIG. 14 during the course of a fighting match. A slidable score keeping member 25 is provided on the upper side of the shaft portion 18.

The character FIG. 14 comprises a torso portion 26, a head portion 28, first and second legs 30 and 32, respectively, and first and second arms 34 and 36, respectively. The torso portion 26 is formed in a hollow configuration, and it comprises front and rear halves 38 and 40, which house various components of an ejecting mechanism 42 which is part of the mounting and control assembly 16 as will hereinafter be more fully set forth. The first leg 30 comprises a main portion 44 and a removable side portion 45 which also house various components of the ejecting mechanism 42. The first leg 30 is pivotally attached to the torso 26 along an axis 46 which extends angularly upwardly and toward the torso portion 26 from the first leg 30 at an angle of preferably approximately 45 degrees. The first leg 30 is mounted on the torso 26 so that when the torso 26 is in an upright disposition on the first leg 30, it is pivotable forwardly thereon but not rearwardly. Further, the first leg 30 is mounted on the torso 26 with an integrally formed tubular mounting shaft 48, which terminates in an enlarged tubular end portion 50. The end portion 50, which is disposed in the interior of the torso 26, is connected to a relatively light gauge spring 52 which is attached to an interior mounting boss 54. The spring 52 is connected to the end portion 50 at a point which causes it to apply a slight biasing force to the torso 26, which in combination with the angular mounting axis of the torso 26 normally maintains the torso 26 in an upright position relative to the first leg 30 when the first leg 30 is in a stationary upright disposition. However, because the spring 52 is a relatively light guage spring, the torso 26 is nevertheless relatively easily pivotable forwardly on the first leg 30 to simulate waist bending movement. The second leg 32 is pivotally mounted on the torso 26 about a substantially horizontal axis 56 with a pivot shaft 58, which terminates in an enlarged inner end portion 60. The second leg 32 is mounted on the torso portion 26 so that it is freely pivotable in both forward and rearward directions, and it includes an internal weighted element 62 adjacent the lower end thereof which enhances the pivotal movement of the second leg 32 as the character FIG. 14 is rotated on the first leg 30. The first and second arms 34 and 36 are each pivotally mounted on the torso portion 26 with a mounting shaft 58 having an enlarged inner end portion 60. The arms 34 and 36 are mounted so that they are freely pivotable on the torso 26, and they are preferably constructed so that they are of sufficient weight to cause them to be pivoted as the character FIG. 14 is rotated on the first leg 30.

The control and release mechanism 16 comprises a control assembly generally indicated at 64, which is contained in the base 12, and the ejecting mechanism 42, which is contained in the torso portion 26 and the first leg 30 of the character FIG. 14. The control assembly 64 is illustrated most clearly in FIGS. 3 and 4, and it comprises a drive shaft 66 which extends between the control end 22 of the base 12 and the pedestal portion 24 thereof. The drive shaft 66 has an operating knob 68 mounted on one end thereof, and a crown gear 70 is mounted on the opposite end thereof so that it extends into the pedestal portion 24. The control assembly 64 further comprises a mounting shaft 72 which is rotatably received in a bushing 74 which extends upwardly from the bottom wall of the pedestal portion 24. The mounting shaft 72 has a spur gear 76 thereon which is received in intermeshing engagement with the crown gear 70. Mounted on the shaft 72 for rotation therewith above the spur gear 76 is a circular platform member 78 having a recess 80 formed therein for receiving the foot of the first leg 30 of the character FIG. 14 therein. The shaft 72 extends upwardly from the platform member 78, and it has an annular channel 82 formed therein adjacent to the upper terminal end thereof.

The ejecting mechanism 42 is illustrated most clearly in FIGS. 5 through 8. The ejecting mechanism 42 comprises a front contact plate 84 having a rearwardly extending shaft 86 thereon which extends rearwardly through the front torso half 38. The ejecting assembly 42 further comprises a pivotally mounted cam plate 88 having an angular cam element 90 thereon. The cam plate 88 is pivotally mounted about an axis 92, and it is engageable by the shaft 86 for moving the cam element 90 rearwardly in the torso portion 26. Also included in the ejecting mechanism 42 is a vertically mounted actuator shaft 94 having a disk portion 96 thereon which is engageable by the cam element 90 for moving the shaft 94 downwardly in the torso portion 26. Mounted on the lower end of the shaft 94 is a conical cam element 98 which communicates with a shaft 100 which extends through the tubular end portion 50 and shaft 48, terminating in an enlarged lower cam portion 102. The shaft 100 is positioned so that when the shaft 94 is moved downwardly in the torso portion 26, the shaft 100 is moved downwardly through the end portion 50 and the shaft 48 by the interaction between the conical cam element 98 and the shaft 100. Contained within the first leg 30 is a vertical transfer member 104 having a rounded cam element 106 on the lower end thereof. The transfer member 104 also includes an upper edge or surface 108 which is received in engagement with the cam member 102 so that when the cam member 102 is moved downwardly as the shaft 100 thereof is moved downwardly through the end member 50 and the shaft 48, the cam member 102 moves the transfer member 104 downwardly in the first leg 30. A latch member generally indicated at 108, which includes a vertically extending upper leg portion 110 and a horizontally extending lower plate portion 112, is provided in the leg 30 below the transfer member 104. The latch member 108 is biased to a rearward position in the leg 30 with a spring 114, and the upper end of the leg 110 has an angular surface thereon which communicates with the rounded cam element 106 on the transfer member 104 for moving the latch member 108 forwardly in the leg 30 when the transfer member 104 is moved downwardly therein. The lower plate portion 112 has a circular opening 116 therein and the shaft 72 passes through the opening 116 so that the lower plate portion 112 is receivable in the channel 82 for releasably retaining the leg 30 on the mounting shaft 72 in the manner illustrated in FIG. 7. In this regard, the first leg 30 has a cylindrical opening 118 formed therein which extends upwardly from the bottom end of the foot thereon and a coil spring 120 is received and secured in the opening 118. Accordingly, the first leg 30 is securable on the mounting shaft 72 by inserting the shaft 72 into the opening 118 so that the spring 120 is compressed until the terminal end portion of the shaft 72 passes through the opening 116 in the lower plate portion 112. As this occurs, the plate portion 112 is moved into engagement with the shaft 72 in the channel 82 for releasably retaining the leg 30 on the shaft 72. In this regard, as the shaft 72 is passed into the opening 118, the spring 114 urges the lower plate portion 112 into a position of engagement with the shaft 72 in the channel 82. However, when the contact plate 84 is moved inwardly so that the transfer member 104 is moved downwardly causing the cam element 106 thereon to move the latch member 108 forwardly in the leg 30, the lower plate portion 112 is removed from the channel 82 in the mounting shaft 72 causing the character FIG. 14 to be ejected from the shaft 72 by the coil spring 120.

Accordingly, for use in operation of the character figure assembly 10, the character figure element 14 is assembled on the mounting shaft 72 so that the latch element 108 is received in engagement in the channel or notch 82. The knob 68 can then be rotated so that the shaft 82 and the platform 78 are rotated. Since the foot portion of the leg 30 is received in the recess 80 in the platform 78, the leg 30 is rotated with the shaft 72 and the platform 78 causing the character FIG. 14 to rotate or spin about the axis of the first leg 30. When the character FIG. 14 is rotated at a relatively rapid rate, the torso portion is pivoted forwardly on the leg 30 by centrifugal force to simulate a waist bending motion, and the second leg 32 and the arms 34 and 36 are also pivoted by centrifugal force as the character FIG. 14 is rotated. In this regard, the weight element 62 in the second leg 32, and the weight of the arms 34 and 36 normally causes the leg 32 to be pivoted with a kicking motion and the legs 34 and 36 to be pivoted with simulated punching actions.

Figure 9:
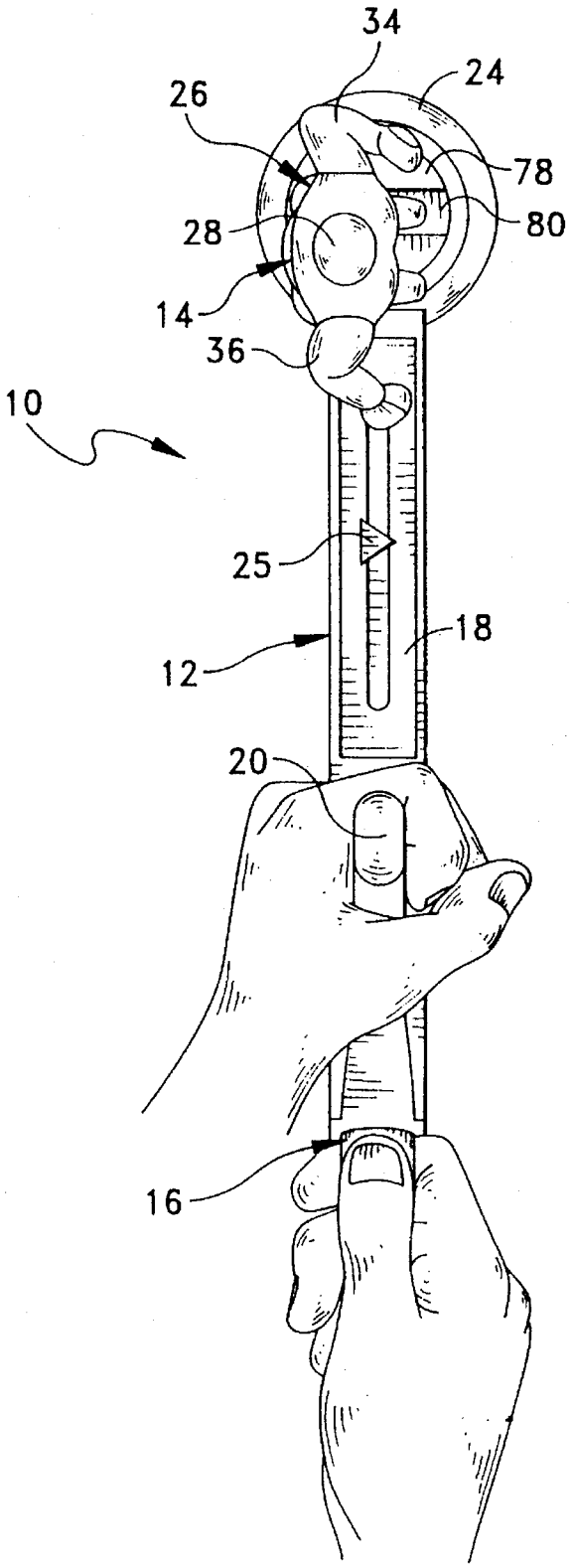
FIG. 9 is a top plan view illustrating the operation of the character figure assembly.
Figure 10:
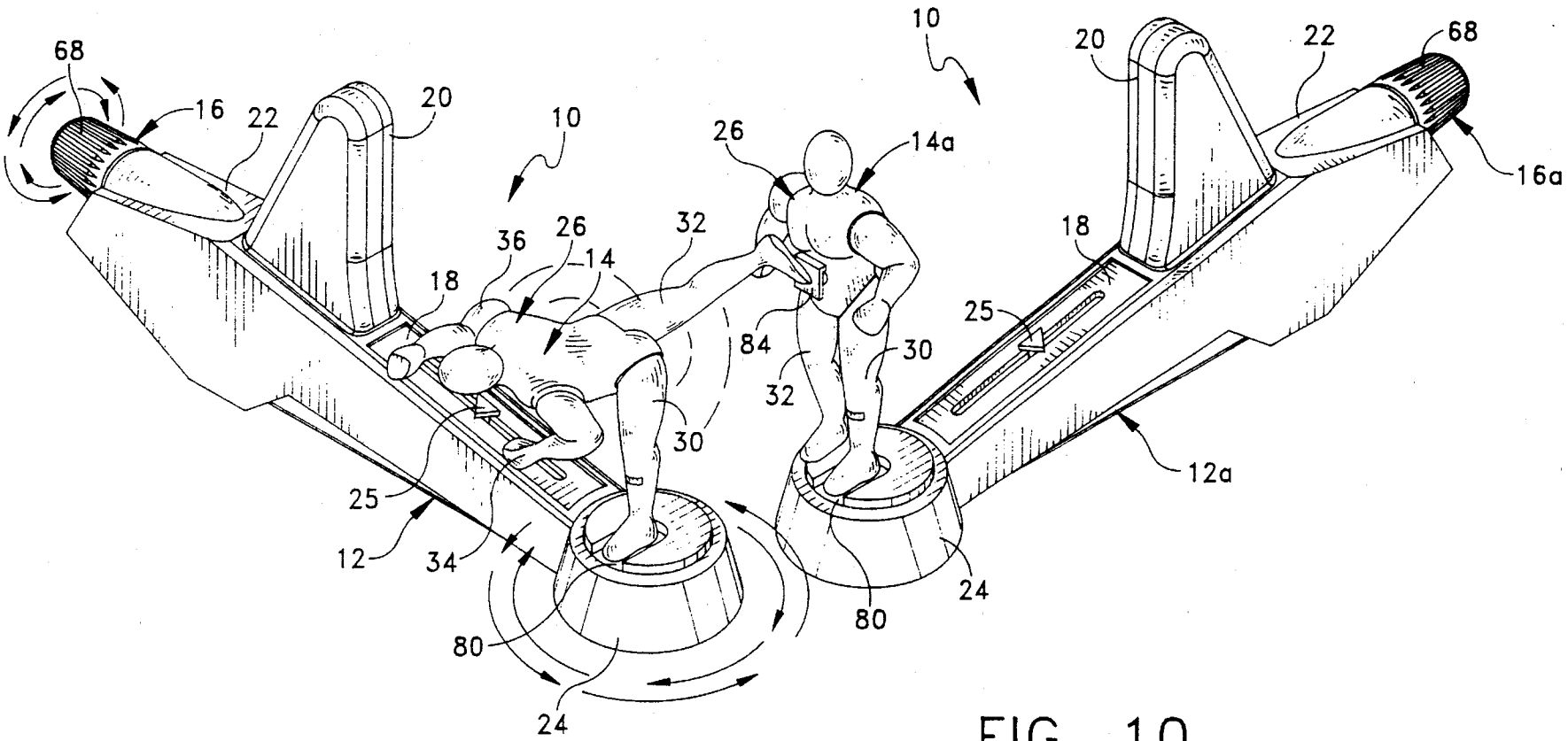
FIGS. 10 and 11 are perspective views illustrating the operation of a pair of the character figure assemblies during a simulated fighting match.
Figure 11:
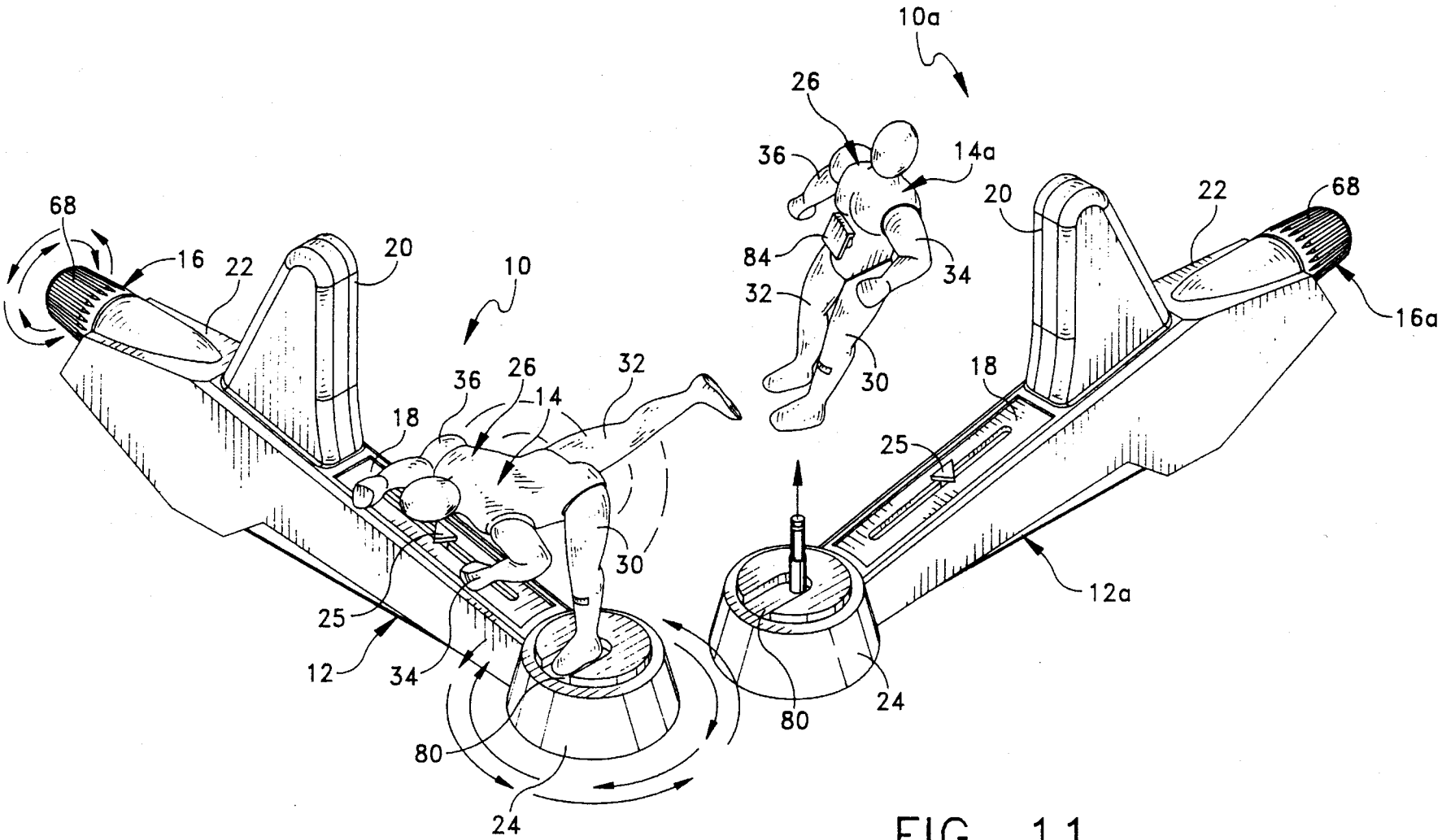

As illustrated in FIGS. 9–11, the character figure assembly 10 is adapted to be effectively utilized in a competitive martial arts fighting match with a similar character figure assembly **10*a*, which is adapted to be operated and controlled in a manner identical to that hereinabove described with respect to the assembly 10. Specifically, the character figure assemblies 10 and 10*a*, which include functionally identical base portions 12 and 12*a*, respectively, character FIGS. 14 and 14*a*, respectively, and mounting and control mechanisms 16 and 16*a*, respectively, can be operated so as to cause the character FIGS. 14 and 14*a* to engage in a simulated martial arts fighting match. As illustrated, when the knob 68 of the assembly 10 is rotated, it causes the character FIG. 14 thereof to be rotated about the axis of the first leg 30 thereof. This causes the torso portion 26 of the character FIG. 14 to be pivoted forwardly in a simulated waist bending action, and it also causes the second leg 32 thereof to be pivoted in a manner simulating a kicking motion. Further, it causes the arms 34 and 36 to be pivoted so as to simulate punching actions. Accordingly, when the character figure assembly 10 is properly positioned to contact the character FIG. 14*a* of the assembly 10*a*, and the knob 68 of the assembly 10 is rotated, the leg 32 of the character FIG. 14 can be pivoted with a kicking action so as to engage the chest plate 84 of the character FIG. 14*a*. When the chest plate 84 is engaged with sufficient momentum to cause the latch plate 108 of the character FIG. 14*a* to be disengaged from the respective mounting shaft 72 thereof, the character FIG. 14*a* is automatically ejected upwardly from the shaft 72 thereof in a manner simulating a reflex reaction to a severe kick from the character FIG. 14**.

It is seen, therefore, that the instant invention provides an exciting character figure assembly which is effectively operable in a simulated high speed martial arts fighting match. The character FIG. 14 is adapted to move in a realistic manner with actions which simulate actual martial arts fighting maneuvers. Further, the mounting and control mechanism 16 is operative for effectively rotating the character FIG. 14 and for causing it to be ejected from the mounting shaft 72 in the event that it sustains a severe blow to the chest area. Hence, it is seen that the character FIG. 10 has a significant level of play value, and that it therefore has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An action character figure assembly comprising:

(a) a base;

(b) a character figure including a torso, first and second legs, means pivotally mounting said torso on said first leg so that said torso is centrifugally pivotable forwardly thereon upon rotation of said character figure on said first leg, but so that when said first leg is in a substantially upright stationary disposition, said torso normally assumes a substantially upright disposition thereon, and means pivotally mounting said second leg on said torso so that said second leg depends therefrom in freely forwardly and rearwardly pivotable relation; and (c) mounting and control means for rotatably mounting said first leg in a substantially upright disposition on said base, said mounting and control means being remotely operable for rotating said first leg on said base and for thereby rotating said character figure thereon in a manner causing said torso to be pivoted on said first leg and said second leg to be pivoted on said torso.

2. In the action character figure assembly of claim 1, said base including an elongated shaft portion having opposite ends, said mounting and control means rotatably mounting said character figure on said first leg thereof adjacent a first end of said shaft portion, said mounting and control means being remotely operable from a point adjacent an opposite second end of said shaft portion for rotating said character figure on said base.

3. In the action character figure assembly of claim 1, said character figure further comprising first and second arms freely pivotably mounted on said torso.

4. In the action character figure assembly of claim 2, said mounting and control means including a rotatable control member adjacent said second end of said shaft portion, said control member being rotatable for remotely rotating said character figure on said base.

5. The action character figure assembly of claim 1 further comprising ejecting means actuatable for ejecting said character figure upwardly from said base.

6. In the action character figure assembly of claim 5, said ejecting means including a contact plate on said torso, said contact plate being depressible inwardly for actuating said ejecting means to eject said character figure upwardly from said base.

7. In the action character figure assembly of claim 1, said torso being pivotally mounted on said first leg about an axis which extends angularly upwardly and toward said torso from said first leg.

8. In the action character figure assembly of claim 7, said torso being pivotally mounted on said first leg about an axis which extends angularly upward toward said torso from said first leg at an angle of approximately 45 degrees relative to vertical.

9. In the action character figure assembly of claim 1, said mounting and control means including a rotatable platform on said base, said first leg being mounted on said platform, said platform being remotely rotatable for rotating said character figure on said base.

10. In the action character figure assembly of claim 5, said mounting and control means including an upwardly extending mounting shaft on said base, said first leg having an upwardly extending opening in the lower extremity thereof, said mounting shaft being receivable in said opening for mounting said first leg on said base.

11. In the action character figure assembly of claim 10, said ejecting means being releasably engageable with said mounting shaft for releasably retaining said character figure on said mounting and control means.

12. In the action character figure assembly of claim 8, said second leg being pivotally mounted on said torso about a substantially horizontal axis.

13. In the action character figure of claim 5, said ejecting means being actuatable for ejecting said character figure so that said character figure is disconnected from said base.

* * * * *